US005244392A

United States Patent [19]

Maursetter

[11] Patent Number: 5,244,392

[45] Date of Patent: Sep. 14, 1993

[54] TETHERED BALL APPARATUS

[76] Inventor: Jeral F. Maursetter, 124 Placid Farms Dr., Venus, Fla. 33960

[21] Appl. No.: 919,752

[22] Filed: Jul. 27, 1992

[51] Int. Cl.[5] ..... A63B 69/00

[52] U.S. Cl. ..... 434/247; 273/26 E; 273/58 C

[58] Field of Search ..... 434/247, 252, 251; 273/26 R, 26 E, 25, 184 B, 185 C, 185 D, 196 R, 197 R, 197 A, 198 R, 200 R, 200 B, 58 C

[56] References Cited

U.S. PATENT DOCUMENTS

| | | | |
|---|---|---|---|
| 1,732,971 | 10/1929 | Kappeler | 273/35 R |
| 2,305,187 | 12/1942 | Neiden | 273/26 E |
| 2,976,040 | 3/1961 | Bales | 273/26 E |
| 3,837,654 | 9/1974 | Hall | 273/200 B X |
| 4,932,660 | 6/1990 | Wang | 273/200 B X |

*Primary Examiner*—Gene Mancene
*Assistant Examiner*—Jeffrey A. Smith
*Attorney, Agent, or Firm*—Frank A. Lukasik

[57] ABSTRACT

A portable, adaptable, batting apparatus which can be installed on a post or pole or a wall or bulkhead, and can be made portable by installation in a trailer hitch of an automobile or truck. The batting practice apparatus comprises a horizontal, elongated steel tube, fastened to a steel channel and reinforced with a gussett and which may be abutted against a generally vertical post or other vertical surface. A swivel bracket is slipped over a steel bolt at the end of the tube and held between two washers, a coil spring and a lock nut. A dimpled, practice ball is suspended by a plastic covered rope from the swivel bracket.

5 Claims, 3 Drawing Sheets

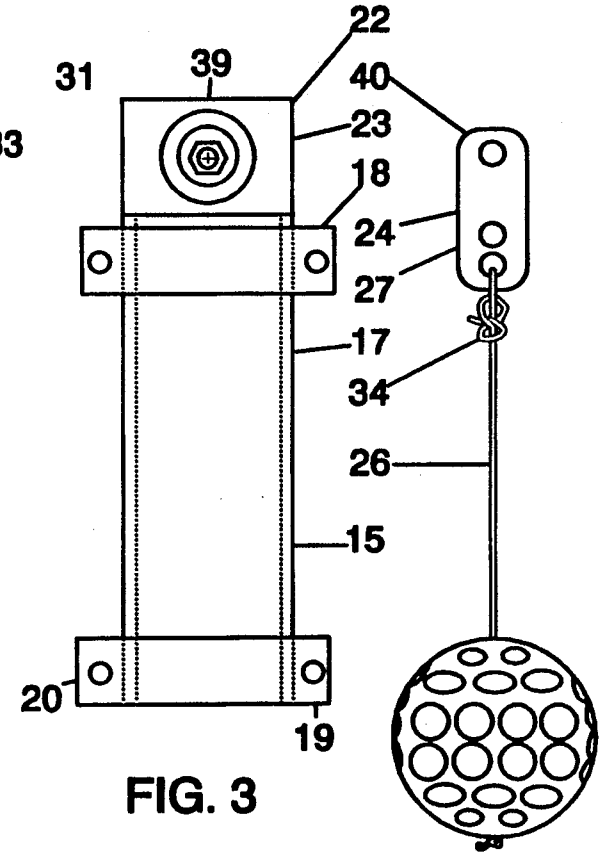
FIG. 4
FIG. 3
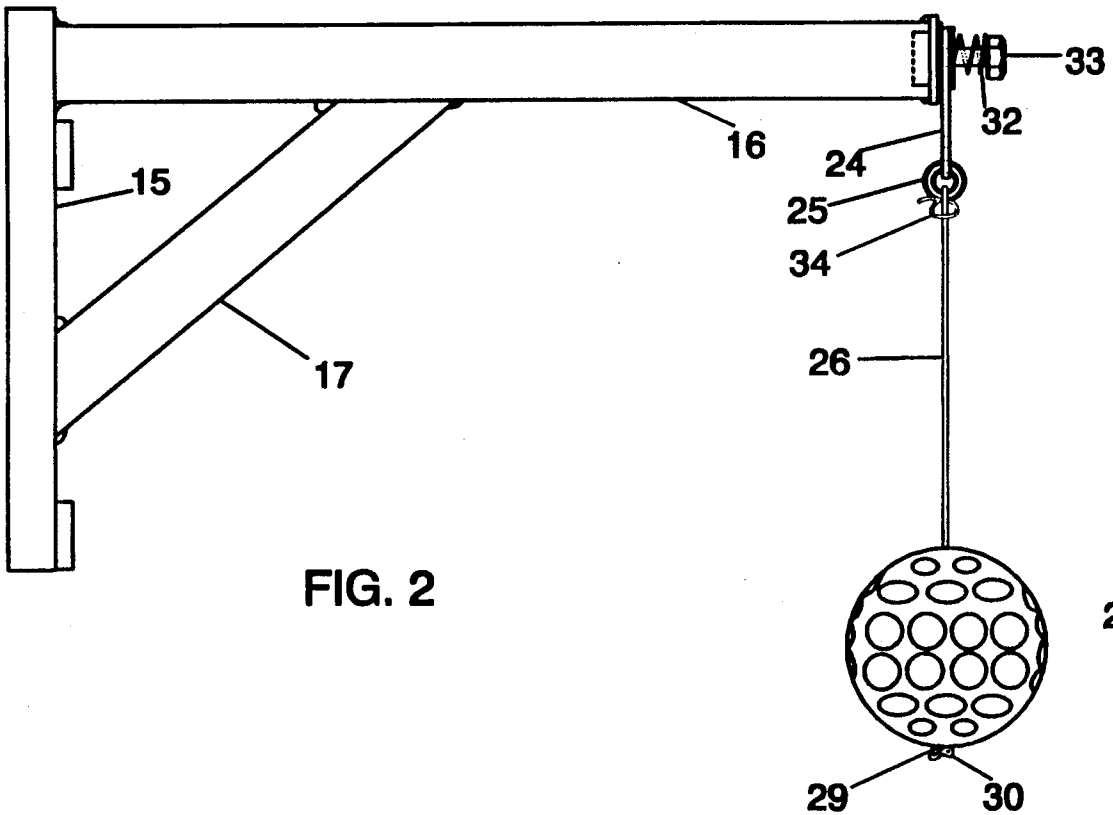
FIG. 2

TETHERED BALL APPARATUS

BACKGROUND OF THE INVENTION

1. Field of the Invention

The present invention relates to a device for teaching and practicing batting skills used in baseball, softball, or any other sports which require hitting a ball.

2. Description of the Relevant Art

Many games, including the game of baseball require that a ball be skillfully hit with a bat, or stick. It is known to provide mechanical apparatus, i.e., pitching machines which assist in the delivery, and re-delivery of baseballs to a batter in a manner which permits a batter to practice, and a hitting instructor to teach proper batting. Unfortunately, such prior art devices are extremely costly and area intensive and therefore are typically only utilized in the commercial setting.

Certain machines are known which throw a ball at a batter standing some distance away, such as the batting machine known as The Casey. These batting machines are, in effect, mechanical pitchers. While they effectively simulate a thrown ball, they have a number of disadvantages for many applications. They are costly to purchase and bulky to transport. They require electricity to operate, and this is not always available at many locations, such as ball fields, where the device would often be used. In addition, the balls hit by the batter must be recovered or "shagged" for the machine to be refilled. The machine is not suited for indoor use in a person's home.

Besides automated batting machines, batting skills are practiced using static "tees" which tee or hold the ball up above ground level. The batter stands next to the tee and attempts to strike the stationary ball held on the tee. Again, the balls must be shagged or recovered to allow practice to continue. This renders tees impractical for a single person to use since the task of recovering the balls quickly becomes tiresome. In addition, tees cannot generally be used indoors unless a net is positioned in front of the tee to catch the batted balls. Again, this makes it impractical or inconvenient to use the device in restricted indoor spaces.

Thus, there is a need for a batting practice device which is simple and quick to install which is durable, which may be easily adjusted, and which does not require shagging of batted balls. Most ball fields have numerous vertical posts or poles, i.e., the poles used as part of the backstop or the fence used in the chain link fences surrounding the fields. In addition, many residential neighborhoods have similar poles. For example, there are poles supporting street signs, stop signs, basketball backboards, etc. Thus a device which could be easily attached to a pole would be valuable and could be widely used if the ball were tethered to it in a tethered manner. In addition, a device which could be fastened to a flat surface, such as a wall, or partition, would be far more flexible and valuable.

Various batting practice devices comprise elongated arms attached to poles which suspend a ball from the arm in a tether type fashion. Such devices are shown in U.S. Pat. No. 3,454,275 to Pontone, U.S. Pat. No. 4,577,864 to Aldrich, U.S. Pat. No. 4,793,612 to Hammond, and U.S. Pat. No. 5,000,450 to Beintema. The patent to Pontone discloses a ball game apparatus comprising an L-shaped arm having one of the branches inserted in a pedestal mountable on a wall and the other of the branches horizontally positionable with respect to the pedestal and supports a string mounted ball which rotates about the horizontal branch when struck by a bat. Aldrich discloses a tethered ball rotationally mounted on a wand, rotating on a handle. Centrifugal motion of the wand around the handle raises the ball to a position of delivery to a batter to swing at the ball. The patent to Hammond discloses a ball batting apparatus using a rotary member journaled for rotation about a shaft, and a flexible linkage holds a ball in a down-hanging position from the rotary member. When the ball is struck with a bat it will move in an arcuate motion about the axis of the rotary member. A backboard mounts the rotary member to a vertical post. The backboard is held by U-bolts which hold the post against a channel formed by spaced-apart parallel spacer bars positioned upon the backboard. Beintema discloses an elongated support arm having support means including an elongated chain which is wrapped around a post and has one end realeasably retained on the support arm against a sliding movement of the chain. The other end of the chain is connected to a bolt which may be drawn through a handle as the handle is rotated to tighten the chain to the post. A ball is suspended from the support arm by an eyelet containing cord to serve as a target for batting practice. A handle which is releasable by hand holds the ball on a reduced diameter stud member at a free end of the support arm.

The patent to Pontone is limited to a single, permanent installation. The patent to Hammond, journaled to rotate about a shaft, would not withstand the punishment of constant hitting because of the fragile nature of the shaft. The patent to Aldrich would require a second person to hold the device while it was being used for batting practice. The patent to Beintema consists of an elaborate gear and chain system for adjusting the height of the device.

SUMMARY OF THE INVENTION

The present invention specifically addresses and alleviates the above-referenced deficiencies associated in the prior art and comprises an improvement to apparatus for practicing and/or teaching ball batting. More particularly, the present invention comprises a readily portable, easily adaptable, batting apparatus which can be quickly and easily installed on a post or pole, or a wall or bulkhead, and can be made portable by installation in a trailer hitch of an automobile or truck. The batting practice device of the invention comprises a horizontal, elongated steel tube, fastened to a steel channel which may be abutted against a generally vertical post or other vertical surface. A swivel bracket is slipped over a steel bolt at the end of the tube and held between two washers, a coil spring and a lock nut. A dimpled practice ball is suspended by a plastic covered rope from the swivel bracket. The batting practice device may also be fastened to a portable mounting device which is designed to be held in a trailer hitch receiver. The suspended ball member is affixed to the swivel bracket with a steel ring and the rope is tied to the ring to provide an easy removal or for ready adjustments of the suspended height of the ball.

These as well as other features of the present invention will become more apparent upon reference to the drawings.

BRIEF DESCRIPTION OF THE DRAWINGS

FIG. 2 is a side elevational view of the batting device of the invention.

FIG. 3 is a front elevational view of the mounting arm of the invention.

FIG. 4 is a front elevational view of the suspended batting target.

DESCRIPTION OF THE PREFERRED EMBODIMENT

The present invention is an improvement to a portable, indoor-outdoor, all-season apparatus for practicing and for teaching the hitting of balls with bats, particularly the hitting of baseballs or softballs with baseball bats. The apparatus may be used by both the right- and left- handed hitters. The practice and teaching conducted with the apparatus is intended to improve eye and hand coordination, body extension, proper stride, and consistency in batting.

Figure 1:
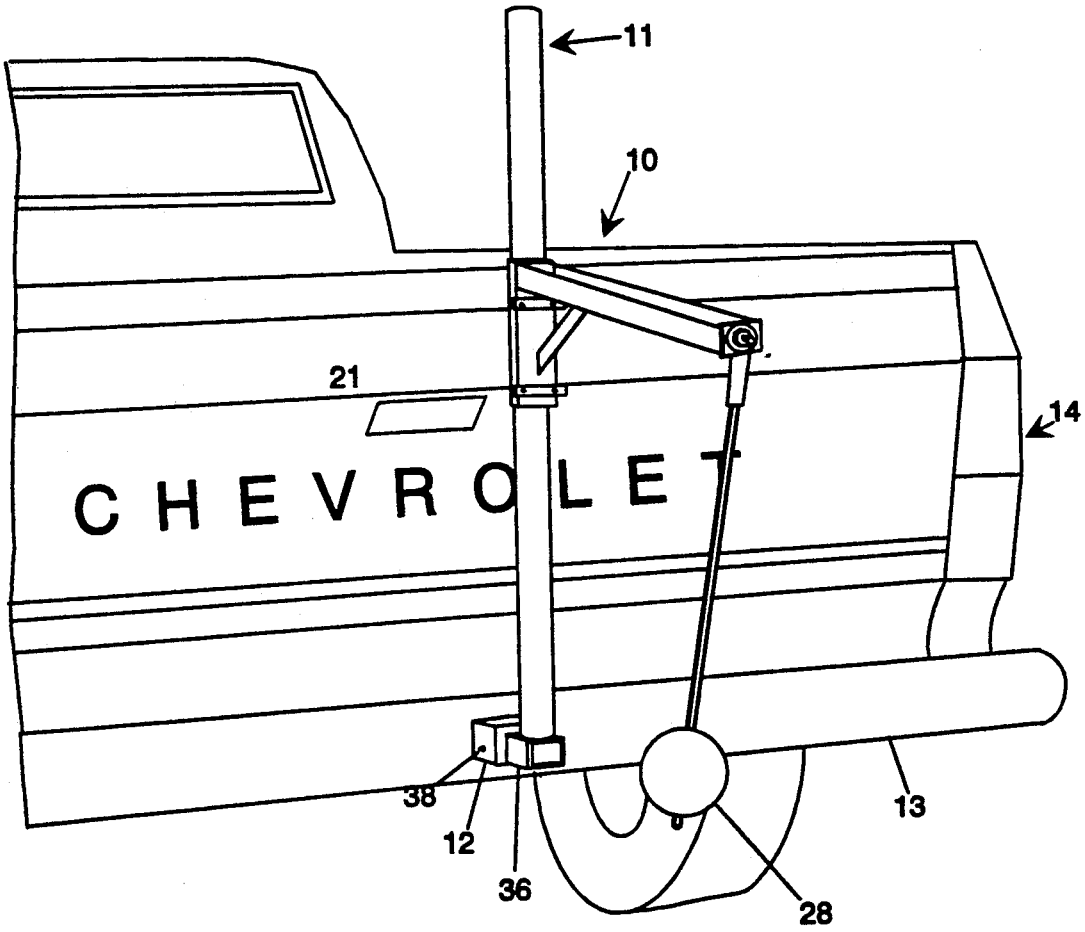
FIG. 1 is a perspective view of the batting device of the invention mounted in a trailer hitch of a pick up truck.
Figure 5:
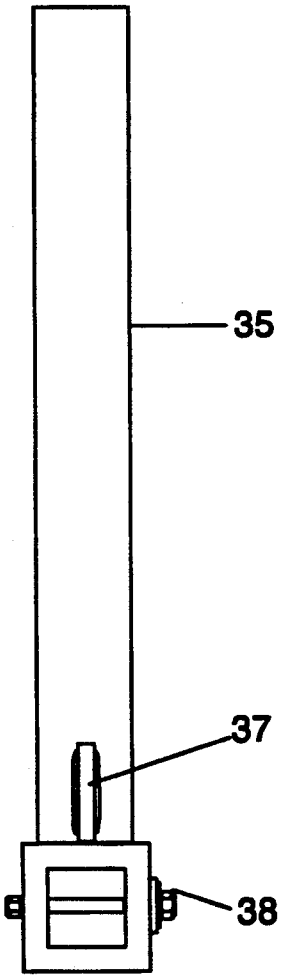
FIG. 5 is a front elevational view of the portable mounting device of the invention.
Figure 6:
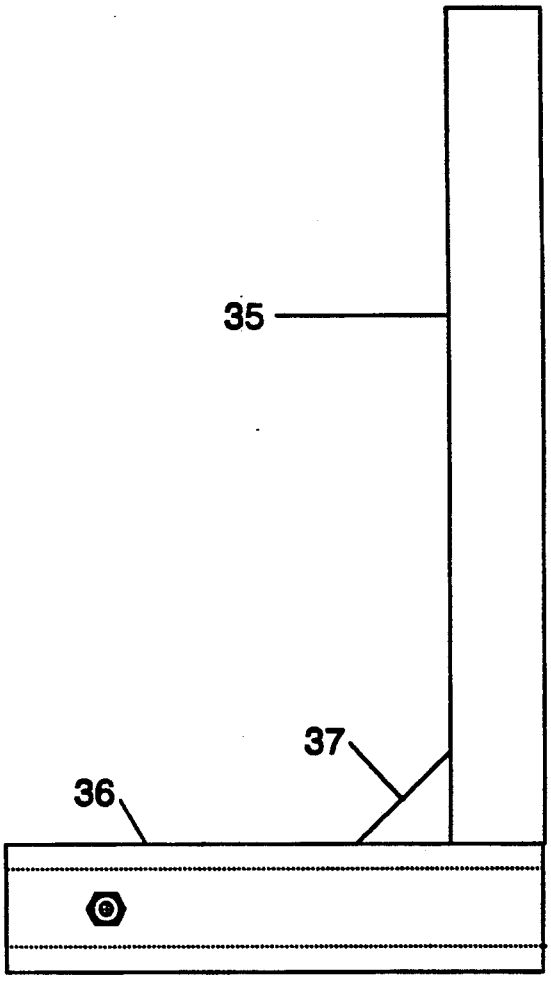
FIG. 6 is a side elevational view of the portable mounting device of the invention.

The tethered ball apparatus 10 of the invention is shown in FIG. 1 in its portable configuration. Portable mounting device 11 is shown mounted in receiver hitch 12 affixed to bumper bumper 13 of truck 14. As shown in FIG. 2, the apparatus 10 generally includes a vertical support member 15 for supporting and mounting an elongate and generally horizontally extending arm 16. Horizontal arm 16 is supported by gussett 17 welded to support member 15 and to arm 16. In a preferred embodiment, vertical support member 15 was fabricated from a 2" steel channel and was 10" long. Gussett 17 was fabricated into a 9½" long by 1" wide by ¼" thick steel flat bar. A mounting bracket 18 is welded to the vertical support member 15 on the front face directly below the horizontal arm 16 and a second mounting bracket 19 is welded near the bottom edge of vertical support member 15 and below the bottom edge of gussett 17. Each of the mounting brackets 18 and 19 have holes 20 drilled therethrough on either side of the vertical support member 15 for fastening the tethered ball apparatus 10 to a vertical support such as portable mounting device 11, or other post, with "U" bolts 21. If a flat surface is available for mounting apparatus 10 thereto, then standard carriage or other bolts may be used. Welded to the end of horizontal arm 16, is a flat plate 22, with pivot bolt 23 running through a hole formed through flat plate 22 and welded to the plate 22 on the back side (inside the horizontal arm 16). In a preferred embodiment, flat plate 22 was fabricated into a 2"×2"×¼" flat bar and the pivot bolt 23 was a ½"×2" steel bolt.

Assembled on pivot bolt 23 is a swivel bracket 24. Swivel bracket 24, in a preferred embodiment, was constructed as a 4"×1"×¼" flat steel plate with a ½" hole 40 for pivot bolt 23 to form a pivot point. A two inch fender washer 31 is fitted on pivot bolt 23 between the flat plate 22 and swivel bracket 24. A flat washer 39 and coil spring 32, used to reduce the RPM's of tethered ball 28, are slipped over pivot bolt 23 and a lock nut 33 is threaded on pivot bolt 23 to complete the assembly of the tethered ball apparatus 10. Two 7/16" holes 27 are formed in the lower portion of bracket 24 to provide a means for hanging the steel ring 25 for fastening the vinyl covered, braided rope 26. Braided rope 26 is wrapped around steel ring 25 and knotted as at 34 to secure the rope 26 to the ring 25. Vinyl covered braided rope 26 is passed through a hole formed through dimple style softball or baseball 28 and held in place by a grommet 29 and knot 30. The hitting height of ball 28 may conveniently be adjusted by using varying lengths of rope 26 or by adjusting the height of the tethered ball apparatus 10 by sliding the vertical support member 15 up or down the portable mounting device 11 or any other vertical mounting post. In a preferred embodiment two ⅜"×2½" "U" bolts 21 were used.

Portable mounting device 11 may be constructed with a steel vertical support pipe 35 fastened at one end of a section of steel horizontal box tubing 36. Gussett 37 is fastened at the point where support pipe 35 and box tubing 36 are joined together to provide additional support and stability for pipe 35. A bolt, washer, and nut assembly 38 are used to secure the box tubing 36 in the receiver hitch 12 when the apparatus 10 is used in the portable mode. In a preferred embodiment, vertical support pipe 35 was constructed from 1⅜" steel pipe, 54" long. The horizontal box tubing 36 was constructed from 2"×2"×¼" steel, box tubing and was 15" long. The various sections of the portable mounting device 11 as well as the tethered ball apparatus 10 were fastened together by welding.

In using portable mounting device 11, the tethered ball apparatus 10 is mounted at a certain height. Height adjustment can be accomplished by loosening the "U" bolts 21 or a plurality of ball 28 and rope 26 units could be provided having different lengths of rope 26 for suspending balls 28 at various heights. Thus height adjustment could be accomplished by installing a ball and rope 26 on the end of horizontal support arm 16 which is selected so that ball 28 is at the right height.

It is understood, of course, that the foregoing disclosure relates to only a preferred embodiment of the invention, and that it is intended to cover all changes and modifications of the examples of the invention herein chosen for the purpose of the disclosure which do not constitute departures from the spirit and scope of the invention.

I claim:

1. A tethered ball batting apparatus comprising:

a generally vertical surface, steel channel means for abutting against said generally vertical surface, said channel means having a top and a bottom end and upper bracket means affixed thereto below said top end and lower bracket means affixed at said bottom end, said bracket means having outer ends with holes drilled therethrough, a horizontally extending, rectangularly shaped, arm having a first end and a second end, said first end being affixed to said top end of said channel means and said second end having a flat plate with pivot means affixed thereto, gusset means affixed to said channel means above said lower bracket means and extending angularly upwardly and affixed to said arm for supporting said arm in a horizontal position, fastener means fitted to said holes in said bracket means for removably fastening said channel means to said vertical surface thereby making said batting apparatus portable, and swivel means rotatably mounted on said pivot means, said swivel means having a fender washer, a swivel bracket, a flat washer, and a lock nut mounted on said pivot means, and a tethered ball affixed thereto and suspended therefrom.

2. A tethered ball apparatus as described in claim 1 wherein said vertical surface comprises a steel pipe fastened at a first end of a section of steel horizontal box tubing and a second end of said steel box tubing dimensioned to fit into a two inch receiver hitch.

3. A tethered ball apparatus as described in claim 1 wherein said vertical surface is a flat surface and said fastener means consist of standard bolts.

4. A tethered ball bating apparatus comprising:

steel channel means for abutting against a generally vertical surface, said channel means having a top and a bottom end and upper bracket means affixed thereto below said top end and lower bracket means affixed at said bottom end, said bracket means having outer ends with holes drilled therethrough, said vertical surface consisting of a steel pipe fastened at a first end of a section of steel horizontal box tubing and a second end of said steel box tubing dimensioned to fit into a two inch receiver hitch, a horizontally extending, rectangularly shaped, arm having a first end and a second end, said first end being affixed to said top end of said channel means and said secondend having a flat plate with pivot means affixed thereto, gusset means affixed to said channel means above said lower bracket means and extending angularly upwardly and affixed to said arm for supporting said arm in a horizontal position, fastener means fitted to said holes in said bracket means for fastening said channel means to said vertical surface, and swivel means rotatably mounted on said pivot means, said swivel means having a fender washer, a swivel washer, a swivel bracket, a flat washer, a coil spring, and a lock nut mounted on said pivot means, and a tethered ball affixed thereto and suspended therefrom.

5. A tethered ball batting apparatus comprising:

a steel channel dimensioned to fit against a generally vertical surface, said steel channel having a top and a bottom end and upper bracket means affixed thereto below said top end and lower bracket means affixed at said bottom end, said bracket means having outer ends with holes drilled therethrough dimensioned for fitting with "U" bolts, a horizontally extending arm having a first end and a second end, said first end being affixed to said top end of said channel and said second end having a flat plate with pivot bolt affixed thereto, a steel gusset affixed to said steel channel above said lower bracket, extending angularly upwardly, and affixed to said arm for supporting said arm in a horizontal position, a portable vertical mounting post having a steel pipe fastened at a first end of a section of steel horizontal box tubing, a steel, angular gusset fastened to said pipe and said box for reinforcing said pipe, a second end of said steel box tubing dimensioned to fit into a receiver hitch, fastener means fitted to said holes in said bracket means for fastening said channel to said mounting post, and swivel means rotatably mounted on said pivot means, said swivel means consisting of a fender washer, a swivel bracket, a flat washer, a coil spring and a lock nut mounted on said pivot bolt, and a tethered ball affixed thereto and suspended therefrom.

* * * * *